343-909 SR
5/3/77 XR 4,021,812

United States Patent [19]
Schell et al.
[11] 4,021,812
[45] May 3, 1977

[54] LAYERED DIELECTRIC FILTER FOR SIDELOBE SUPPRESSION

[75] Inventors: Allan C. Schell, Winchester; Robert J. Mailloux, Wayland, both of Mass.

[73] Assignee: The United States of America as represented by the Secretary of the Air Force, Washington, D.C.

[22] Filed: Sept. 11, 1975

[21] Appl. No.: 612,530

[52] U.S. Cl. ..... 343/753; 343/909
[51] Int. Cl.[2] ..... H01Q 15/00
[58] Field of Search ..... 343/753, 754, 909, 911 R, 343/784, 872

[56] References Cited

UNITED STATES PATENTS 2,763,860 9/1956 Ortusi et al. ..... 343/909
3,698,001 10/1972 Koyama et al. ..... 343/909
3,835,469 9/1974 Chen et al. ..... 343/754

*Primary Examiner*—Eli Lieberman
*Attorney, Agent, or Firm*—Joseph E. Rusz; Willard R. Matthews, Jr.

[57] ABSTRACT

Sidelobe suppression in directional beam forming antennas is accomplished by means of a spatial filter. The filter geometry consists of flat layers of high dielectric constant dielectric separated by air or other low dielectric constant dielectric substance. The filter is placed directly over the antenna radiating aperture and its dielectric materials have dielectric constant and thickness values that effect full transmission of beam power in a selected beam direction and substantial rejection of it in other directions.

3 Claims, 6 Drawing Figures

LAYERED DIELECTRIC FILTER FOR SIDELOBE SUPPRESSION

STATEMENT OF GOVERNMENT INTEREST

The invention described herein may be manufactured and used by or for the Government for governmental purposes without the payment of any royalty thereon.

BACKGROUND OF THE INVENTION

This invention relates to directional beam forming antennas, and in particular to dielectric layer spatial filters for suppressing the sidelobes of beams transmitted by such antennas.

The performance of phased arrays and other directional beam forming antennas is often degraded by the presence of sidelobes and grating lobes in the transmitted beam. A particular problem is represented by the residual grating lobes that plague limited sector scanning and multiple beam arrays in airport precision-approach radar systems and synchronous satellite communications antennas. In the past, for each individual case, sidelobe problems have been overcome by redesigning the antenna. Such an approach is, of course, both inflexible and expensive. There currently exists, therefore, the need for greatly simplified, lightweight, inexpensive means for suppressing sidelobes and grating lobes in beams transmitted by directional beam-forming antennas. The present invention is directed toward satisfying that need.

SUMMARY OF THE INVENTION

The spatial filter comprehended by the invention comprises a plurality of layers of dielectric with alternate layers being of high and low dielectric constant substances. The low dielectric constant layers can conveniently be air gaps between sheets of selected high dielectric constant material. The thickness, dielectric constant and spacing parameters of the high dielectric constant layers are chosen to establish filter transmission properties that depend on the angle of beam incidence. These transmission properties are tailored to provide good transmission of radiation in the direction of the main beam and substantial rejection for radiation at angles outside the sector or cone of coverage swept by the main beam.

It is a principal object of the invention to provide new and improved means for suppressing sidelobes in beams transmitted by directional beam-forming antennas.

It is another object of the invention to provide a layered dielectric spatial filter adapted to suppress sidelobes and grating lobes in beams transmitted by directional beam-forming antennas.

It is another object of the invention to provide a greatly simplified, lightweight, inexpensive means for suppressing sidelobes and grating lobes.

These, together with other objects, features and advantages of the invention, will become more readily apparent from the following detailed description taken in conjunction with the illustrated embodiment in the accompanying drawings.

DETAILED DESCRIPTION OF THE PREFERRED EMBODIMENTS

Figure 1:
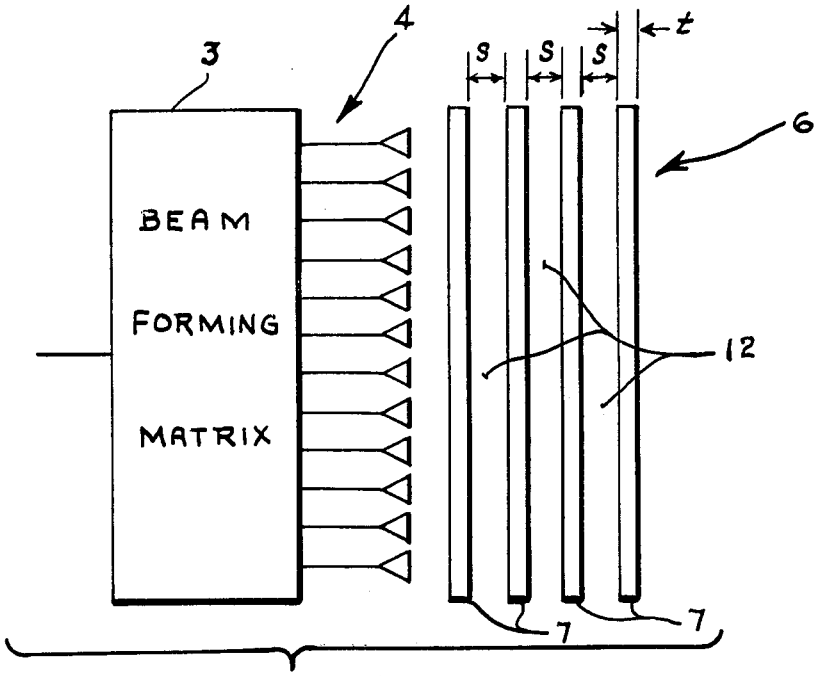
FIG. 1 illustrates one presently preferred embodiment of the invention.

The layered dielectric filter of the invention is a spatial domain filter as differentiated from conventional frequency domain filters.

The principles of layered-dielectric frequency-domain filters and impedance transformers are well established, and in the development of the filter herein disclosed the techniques for analysis and synthesis in this domain have been when possible extended to the spatial domain. The fundamental difference between synthesis in the frequency domain and synthesis in the spatial domain arises because the transmission coefficients of layers that have a high dielectric constant are strongly frequency-dependent but relatively invariant with the spatical angle of incidence; if a wave from a medium of low dielectric constant is incident on a medium of high dielectric constant, then for any angle of incidence the wave propagation angle in the latter is almost perpendicular to the interface.

This distinction is the basis for the fundamental change in filter design comprehended by the present invention. The frequency-domain transformers and filters synthesized by prior art techniques consist of various dielectric layers sandwiched together. The spatial domain filters synthesized in accordance with principles of the invention consist of quarter-wave sections of dielectric separated by half-wave or full-wave air spaces.

The procedure for transformer synthesis depends on the demonstrated properties of the polynomial expression for the power loss ratio, defined as the power ratio associated with the inverse of the filter transmission coefficient:

$$P = A_{11}A^*_{11}. \quad (1)$$

Using filter elements consisting of sections of transmission line each quarter-wavelength long at the design frequency, it has been proved that the power loss ratio was an even polynomial of cos $k_z t$ of degree $2n$, where $n$ is the number of sections in the filter. It has also been shown that the power loss polynomial could be written as unity plus a positive constant times the suare of Chebyshev polynomial $T_n(x)$, and that $n$ characteristic impedance values are sufficient to define the Chebyshev transformer, with the ripple level given by the value of the positive constant.

The fundamental difference between the present invention and the transformer synthesis techniques currently employed is that the device of the invention is a spatial filter rather than a frequency filter. If the air spaces $S_j$ were set equal to zero, this analysis would also lead to power loss ratios that are even powers of cos $kz_j t$. The difference is that in the case of a frequency filter the $k_o = 2\pi/\lambda_o$ varies directly with the frequency; in the case of a spatial filter with $\epsilon_j$ large compared with unity, $k_{z_j}$ varies very little over a wide range. Logically therefore, procedures for designing a spatial filter are not directly analogous to those established for designing quarter-wave transformers.

In considering the spatial domain dielectric constants of the filter media are assumed to be large enough for the $\theta$-dependence of the $^{k}z_j$ in the various layers to be neglected. It is also assumed that the air-dielectric junction characteristics are constant with $\theta$. if the thickness of each dielectric layer is a quarter-wavelength at the design frequency and the air-space distance S between layers is fixed, then the power loss ratios will be even powers of $\cos(k_oS \cos \theta)$ or even powers of $\sin(k_oS \cos \theta)$. In such case the dielectric slab is considered a lumped reactive component; filter synthesis consists of choosing the magnitude of this reactance.

The mathematics of filter synthesis for a spatial Chebyshev filter as comprehended by the invention, is as follows:

The first five Chebyshev polynomials are:

$$T_o(x) = 1,$$

$$T_1(x) = x,$$

$$T_2(x) = 2x^2-1,$$

$$T_3(x) = 4x^3-3x,$$

$$T_4(x) = 8x^4-8x^2+1. \quad (2)$$

The optimal properties of these polynomials are well known, as are their root locations and in-band and out-of-band characteristics. The functions oscillate with amplitude unity throughout the range and all have the value unit at $|x| = 1$. The polynomial $T_m(x)$ has all of its $m$ zeros within this passband range.

An alternative way off expressing the general polynomial $T_m(x) = \cos h\ (m \cos h^{-1}x)$.

This expression is valid for all $x$, but is particularly useful for calculating the stopband polynomial values. Synthesis of spatial filters based on Chebyshev polynomials follows conventional procedure, which begins with the recognition that the power loss ratio is a polynomial in even powers of the sine or cosine of $(k_oS \cos \theta)$. The further specification that the polynomial be one that has m double zeros within the passband is also common to the theory of filter synthesis and has the result that the power loss polynomial can be set equal to the expression:

$$A_{11}A_{11}^* = 1 + \Delta^2\ T_m^2\left(\frac{\sin \zeta}{\sin \zeta_1}\right) \quad (4)$$

where $$\zeta = \frac{2\pi S}{\lambda} \cos \theta,$$

and $\zeta_1$ is the value of $\zeta$ at the passband edge.

This expression is unity plus a polynomial of order $2m$, with double zeros within the region $\sin \zeta < \sin \zeta_1$, and with the maximum ripple $\Delta^2$ within that band. The expression $A_{11}A_{11}^*$ has the minimum value unity at the polynomial zeros.

The coefficient $A_{11}$ of the wave matrix for a filter made of two identical dielectric slabs of dielectric constant $\epsilon$ and thickness $t$ set to a quarter wavelength (in $\epsilon$ ), computed from Equation (1) is $$A_{11} = \frac{1}{S_{21}^2}\ (e^{j\zeta} - S_{11}^2\ e^{-j\zeta}), \quad (5)$$

and $S_{11}$ and $S_{21}$ are computed from standard wave matrix Equation (6).

$$A = \frac{1}{S_{12}}\begin{pmatrix} e^{jk_{z_o}S} & -S_{11}e^{jk_{z_o}S} \\ S_{11}e^{-jk_{z_o}S} & -e^{-jk_{z_o}S} \end{pmatrix} \text{where } S_{11} = \frac{\epsilon - 1}{\epsilon + 1} \quad (6)$$

$$S_{12} = \frac{\epsilon - 2j\sqrt{\epsilon}}{\epsilon + 1}$$

Since $S_{11}$ is real, the power loss ratio is:

$$A_{11}A_{11}^* = 1 + \frac{1}{S_{21}^4}\ [4\ S_{11}^2 \sin^2\zeta]. \quad (7)$$

To synthesize a two-layer filter, this ratio is set equal to the expression $$A_{11}A_{11}^* = 1 + \Delta 2\ T_1^2 \frac{\sin \zeta}{\sin \zeta_1}. \quad (8)$$

Defining a constant $$G = \Delta/\sin\zeta_1$$

then leads to the following equation for the dielectric-layer reflection coefficient $$S_{11} = \frac{-1 + \sqrt{1 + G^2}}{G}. \quad (10)$$

Solving for $\epsilon$by means of Equation (10) and selecting the quarter-wave filter thickness for the given $\epsilon$, completes the synthesis procedure given $\Delta^2$ and $\sin \zeta_1$.

The above equations were derived in terms of $\sin \zeta$. Since $\zeta = (2\pi/)S \cos \theta$ , $\sin \zeta$is zero at $(S/\lambda) = n(0.5)$, with $n = 0$ excluded as trivial. In principle, therefore, there are a number of different spacings that will allow proper spatial filter synthesis. In practice, the only reasonable spacings for most applications are $S/\lambda = 0.5$— sometimes $S/\lambda = 1.0$ — because larger spacings have a multitude of spatial pass- and stopbands that do not generally suit the given requirements.

For $S = 0.5\lambda$, there is a passband ($\sin\zeta = 0$) centered at $\cos \theta = 1$ (broadside) and also at $\cos\theta = 0$ (endfire). For $S = \lambda$there are passbands at broadside, at 60°, and at endfire. The 60° passband begins just beyond 40°. Thus, the basic filter can be made so as to have synthesized filtering properties from broadside to somewhat beyond 40°, a spacing that is appropriate if the antenna radiation needs no further reduction for large $\theta$ angles.

Figure 5:
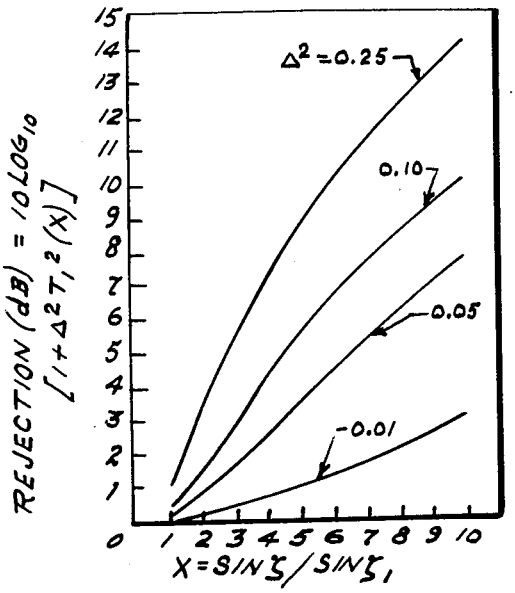
FIG. 5 is a graph showing the rejection ratios for a two-layer Chebyshev filter.

Filter synthesis procedure begins with determining the value of $\zeta_1$ at the end of the passband and the value of some spatial angle variable $\zeta$ at which a given rejection level is required. Equations (3) and (4) give the out-of-band rejection for Chebyshev filters of the general type. FIG. 5 shows the rejection ratios (in decibels) for a two-layer filter for various values of $\Delta^2$ consistent with rejection ratios of up to 30 dB for values of $\sin\zeta/$ $/\sin\zeta_1 < 10$. From this curve it is possible to choose the value of the passband ripple amplitude $\Delta^2$ that will provide a given rejection ratio for a specific value of $\sin\zeta/\sin\zeta_1$. Since the minimum passband transmission coefficient is $1/(1+{}^2)$, the constant $\Delta^2$ must be kept moderately small if excessive ripple is to be avoided in the passband.

Figure 6:
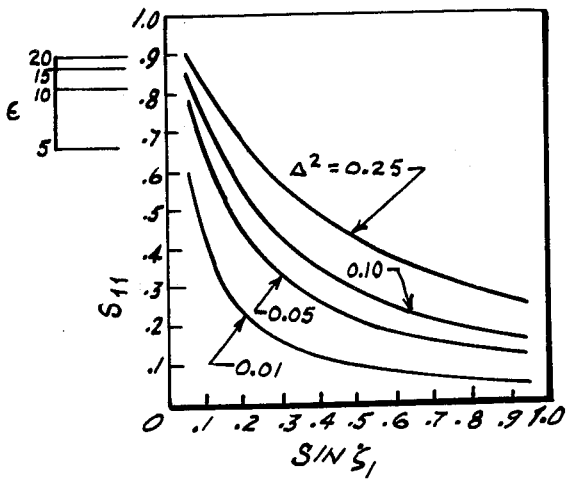
FIG. 6 is a graph showing the reflection coeefficients for a two layer Chebyshev filter.

FIG. 6 must be used in conjunction with FIG. 5. In this latter figure, the required reflection coefficients $S_{11}(1)$ and $S_{11}(2)$ [are plotted versus the values of $\sin\zeta_1$ at the end of the passband; the various $\Delta^2$ values that were used were chosen to cover a range that would give reasonable ripple values while maintaining good filter rejection.

Figure 2:
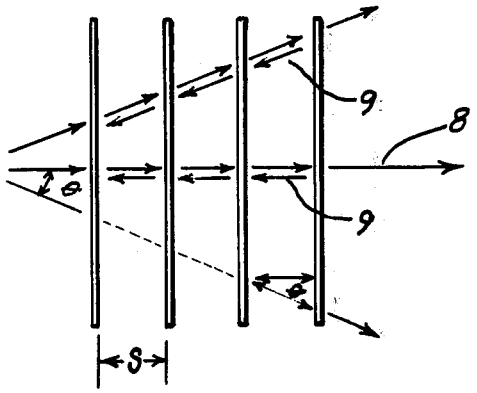
FIG. 2 is a schematic representation illustrating this relationship between a filter comprehended by the invention and a beam at various scan angles.
Figure 3:
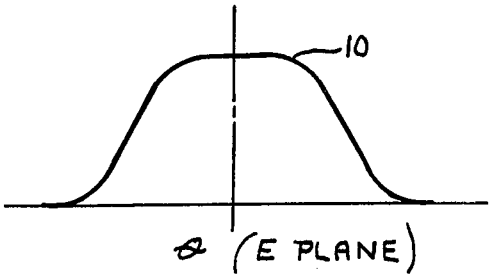
FIG. 3 is a typical field pattern for a beam transmitted through a two-element filter incorporating the principles of the invention.
Figure 4:
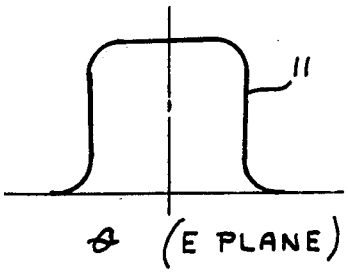
FIG. 4 is a typical field pattern for a beam transmitted through a four-element filter incorporating the principles of the invention.

The essential elements of a spatial filter incorporating the principles of the invention are shown in the presently preferred embodiments of FIG. 1. The filter is shown in relationship to a directional beam-forming antenna comprising the array of radiating elements 4 and beam-forming matrix 3. The spatial filter of the invention comprises the structural arrangement of dielectric substance layers 7, 12. In practice the filter can be mounted in appropriate relationship to the antenna radiating aperture by means of a frame or brackets (not shown). Dielectric layers 7 are of high dielectric constant material and layers 12 are of low dielectric constant material. By way of example, layers 7 can be high dielectriic constant ceramic sheet members or aluminum sheet members and layers 12 can be the air gaps between the ceramic sheets. Layers 12 can also be of any suitable low dielectric material such as polystyrene making the filter a solid "sandwich" type structure. The spacings S between dielectric sheets 7 and the sheet 7 thicknesses together with the dielectric constants chosen determine, in part, the beam radiating pattern. The effect of dimensions S is illustrated by the schematic drawing of FIG. 2. The beam 8 in this instance is intended to be fully transmitted at broadside and rejected at a certain angle off broadside. The dielectric sheets 7 are therefore spaced such that beam energy 9 reflected by the high dielectric constant members exactly cancels out at broadside. It can be seen from the geometry of FIG. 2 that energy reflected when the beam is at an angle $\theta$ travels a longer distance than when the beam is at broadside and would not exactly cancel. By proper design, such reflected energy can be made to add, resulting in rejection of the transmitted beam at and beyond selected beam excrusion limits. In practice operable filters have been constructed using quarter wavlength ceramic high dielectric constant sheets spaced at wavelength and half-wavelength distances S. The number of dielectric material layers or stages of the filter determine how sharply the skirts of the beam radiation pattern fall off. That is, the number of stages can be manipulated to tailor the radiation pattern to a desired shape. This is illustrated by FIGS. 3 and 4 wherein FIG. 3 illustrates a typical beam pattern for a two-stage filter and FIG. 4 illustrates a typical beam pattern for a four-stage filter.

The design and synthesis of any particular spatial filter embodying the concepts of the invention depends of course upon the particular application and beam pattern desired as well as the selected operating frequency and other special parameters involved. The particular values of layer thickness, dielectric contant and layer spacing are derived in each case by filter synthesis procedures. Examples of filter synthesis procedures that develop filters of the type comprehended by the invention are detailed in U.S. Air Force Cambridge Research Laboratories Report AFCRL-TR-74-0455, entitled *Analysis and Snythesis of Spatial Filters That Have Chebyshev Characteristics*, by Robert J. Mailloux, dated Sept. 13, 1974.

Although the Chebyshev design detailed in the report is a good example of the technique and advantages that layered diielectric spatial filters can offer, the invention is not limited to filters designed to have Chebyshev characteristics but pertains to other selected geometries with variable spacings and equal or unequal dielectric constants as can be designed or synthesized by those skilled in the art of wave propagtion and polynomial synthesis.

What is claimed is:

1. Directional beam forming means comprising a phased array antenna having a multiplicity of radiating elements, and a Chebyshev filter, said Chebyshev filter being disposed proximate to the radiating aperture of said radiating elements and in intercepting relationship with electromagnetic wave energy transmitted and received thereby, said Chebyshev filter comprising a plurality of discrete contiguous layers of dielectric substance, alternate layers thereof having high and low dielectric constants, said high dielectric constant layers being a quarter wavelength thick and spaced at integral half wavelength distances so as to effect substantially complete cancellation of beam energy reflected by said sheet members for a given beam direction.

2. A beam filter as defined in claim 1 wherein high dielectric constant layers comprise parallel, spaced high dielectric sheet members and low dielectric constant layers comprise air filled regions therebetween.

3. A beam filter as defined in claim 1 wherein said high dielectric sheet members are quarter wavelength ceramic sheets spaced at wavelength intervals.

* * * * *